US012262824B1

(12) United States Patent
Harris

(10) Patent No.: US 12,262,824 B1
(45) Date of Patent: Apr. 1, 2025

(54) SPORTS MEMORABILIA RACK

(71) Applicant: Jimmy Harris, Warner Robins, GA (US)

(72) Inventor: Jimmy Harris, Warner Robins, GA (US)

( * ) Notice: Subject to any disclaimer, the term of this patent is extended or adjusted under 35 U.S.C. 154(b) by 0 days.

(21) Appl. No.: 18/407,656

(22) Filed: Jan. 9, 2024

(51) Int. Cl.
*A47F 7/00* (2006.01)
*A47G 33/00* (2006.01)

(52) U.S. Cl.
CPC ..... *A47F 7/0007* (2013.01); *A47G 33/004* (2013.01)

(58) Field of Classification Search
CPC .... A47F 7/0007; A47F 7/0014; A47G 33/004
USPC ..... 211/24, 85.7, 14, 33, 49.1, 125, 197; 312/60
See application file for complete search history.

(56) References Cited

U.S. PATENT DOCUMENTS 1,951,894 A * 3/1934 Ziebarth ..... A47F 7/0028 473/410
2,281,849 A * 5/1942 McCoppin ..... A47G 23/025 D7/600
2,756,901 A * 7/1956 Cowsert ..... A47F 1/08 221/311
3,143,265 A * 8/1964 Ruderian ..... A63B 57/20 294/142
3,198,338 A * 8/1965 McCormick ..... A47F 5/06 211/163
3,231,993 A * 2/1966 Levy ..... A47F 7/00 D11/131
3,604,705 A * 9/1971 Hawthorne ..... A63F 7/0076 273/447
3,783,801 A * 1/1974 Engman ..... A47B 87/0215 108/190
4,011,954 A * 3/1977 Galli ..... A47F 5/108 211/188
4,214,684 A * 7/1980 Galowitz ..... A63B 47/00 294/166
4,892,197 A * 1/1990 Slattery ..... A47G 19/28 211/163
4,955,485 A * 9/1990 Alton ..... A47G 1/12 211/188
5,193,443 A * 3/1993 Carney ..... A47J 37/0786 99/449
5,318,189 A * 6/1994 Lee ..... A47G 25/0664 211/205

(Continued)

FOREIGN PATENT DOCUMENTS

GB 2537366 10/2016

*Primary Examiner* — Jennifer E. Novosad
(74) *Attorney, Agent, or Firm* — Kyle A. Fletcher, Esq.

(57) ABSTRACT

The sports memorabilia rack is a display rack. The sports memorabilia rack incorporates a pedestal structure, a plurality of sport figurines and a plurality of connecting structures. Each connecting structure selected from the plurality of connecting structures forms an attachment that either: a) attaching an initial sport figurine selected from the plurality of sport figurines to a subsequent sport figurine selected from the plurality of sport figurines; and, b) attaching a sport figurine selected from the plurality of sport figurines to the pedestal structure. The plurality of connecting structures align the plurality of sport figurines along a vertically oriented axis. The pedestal structure is a load bearing structure. The pedestal structure forms the final link of the load path that transfers the load of the sports memorabilia rack to a supporting surface.

6 Claims, 4 Drawing Sheets

(56) References Cited

U.S. PATENT DOCUMENTS

| | | | | |
|---|---|---|---|---|
| 5,480,026 | A * | 1/1996 | Darling | A63B 47/00 206/315.9 |
| 5,553,707 | A * | 9/1996 | Lion | A45F 5/00 224/678 |
| 5,855,286 | A * | 1/1999 | Zaid | A47K 5/12 211/85.7 |
| 6,029,826 | A * | 2/2000 | Clay | A47G 33/004 248/176.1 |
| 6,364,127 | B1 * | 4/2002 | Richardson | A47G 1/12 D6/552 |
| 6,996,927 | B2 * | 2/2006 | Meidinger | B44C 3/00 211/163 |
| 7,051,886 | B1 * | 5/2006 | Han | C11D 17/041 211/85.12 |
| 8,029,389 | B2 * | 10/2011 | Chiu | A63B 69/0002 473/417 |
| 8,293,342 | B2 * | 10/2012 | Adams | A63H 3/16 428/7 |
| 8,919,577 | B2 * | 12/2014 | Nally | A63B 47/007 211/85.7 |
| 9,538,861 | B2 * | 1/2017 | Young | A47F 5/04 |
| 9,677,750 | B2 * | 6/2017 | Frederick | F21S 6/002 |
| 12,115,647 | B2 * | 10/2024 | Hickey | A47F 5/04 |
| 2002/0011502 | A1 | 1/2002 | Preyss | |
| 2006/0186074 | A1 | 8/2006 | Bair | |
| 2007/0221803 | A1 | 9/2007 | Jouett | |
| 2008/0110066 | A1 | 5/2008 | Peroni | |
| 2019/0183274 | A1 * | 6/2019 | Peters | A47G 33/004 |

* cited by examiner

SPORTS MEMORABILIA RACK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of tabletop displays for households. (A47G/00)

SUMMARY OF INVENTION

The sports memorabilia rack is a display rack. The sports memorabilia rack comprises a pedestal structure, a plurality of sport figurines and a plurality of connecting structures. Each connecting structure selected from the plurality of connecting structures is a threaded connection. Each selected connecting structure forms an attachment selected from the group consisting of: a) attaching an initial sport figurine selected from the plurality of sport figurines to a subsequent sport figurine selected from the plurality of sport figurines; and, b) attaching a sport figurine selected from the plurality of sport figurines to the pedestal structure. The plurality of connecting structures align the plurality of sport figurines along a vertically oriented axis. The pedestal structure is a load bearing structure. The pedestal structure forms the final link of the load path that transfers the load of the sports memorabilia rack to a supporting surface.

These together with additional objects, features and advantages of the sports memorabilia rack will be readily apparent to those of ordinary skill in the art upon reading the following detailed description of the presently preferred, but nonetheless illustrative, embodiments when taken in conjunction with the accompanying drawings.

In this respect, before explaining the current embodiments of the sports memorabilia rack in detail, it is to be understood that the sports memorabilia rack is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sports memorabilia rack.

It is therefore important that the claims be regarded as including such equivalent construction insofar as they do not depart from the spirit and scope of the sports memorabilia rack. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
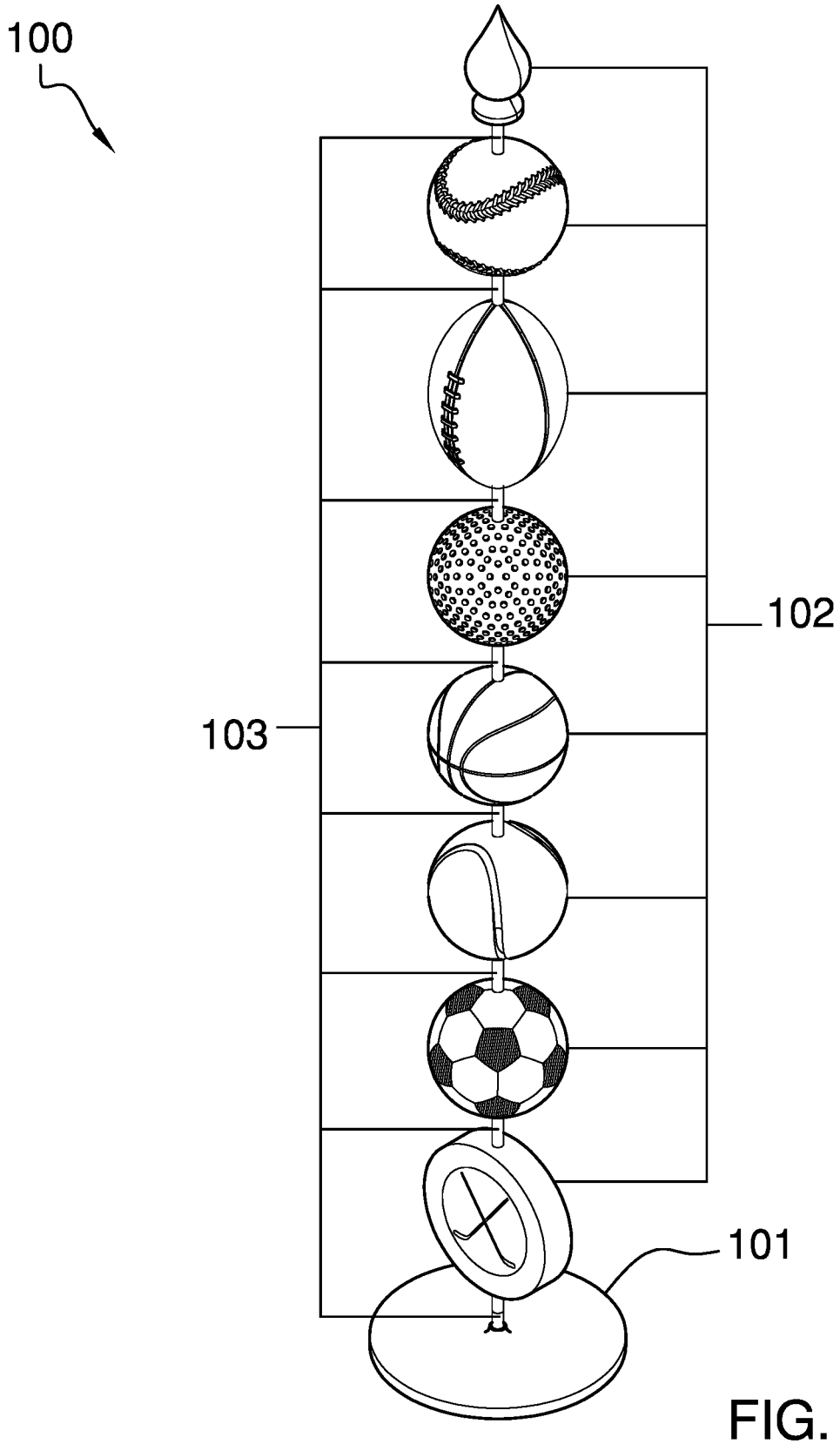
FIG. 1 is a perspective view of an embodiment of the disclosure.
Figure 2:
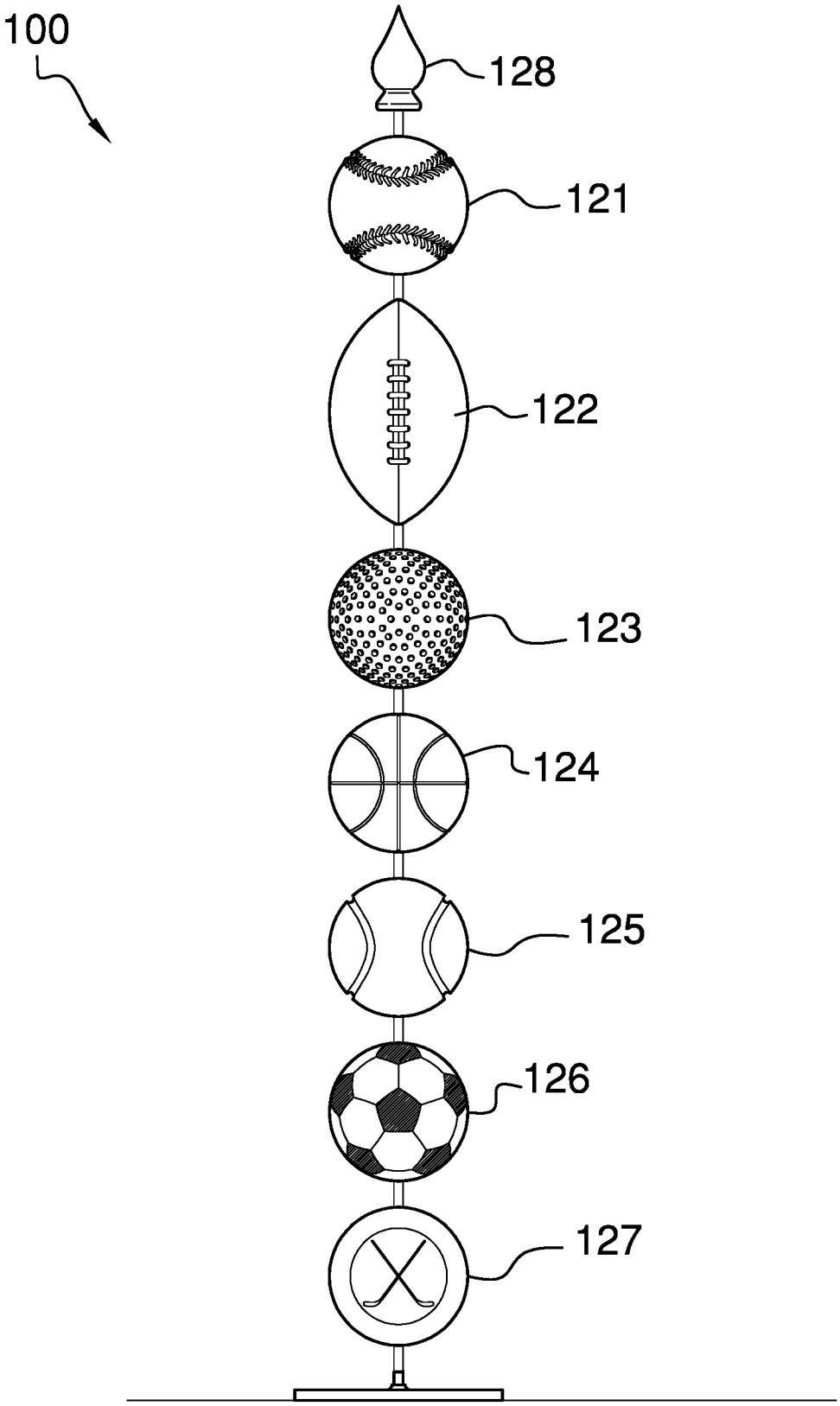
FIG. 2 is a front view of an embodiment of the disclosure.
Figure 3:
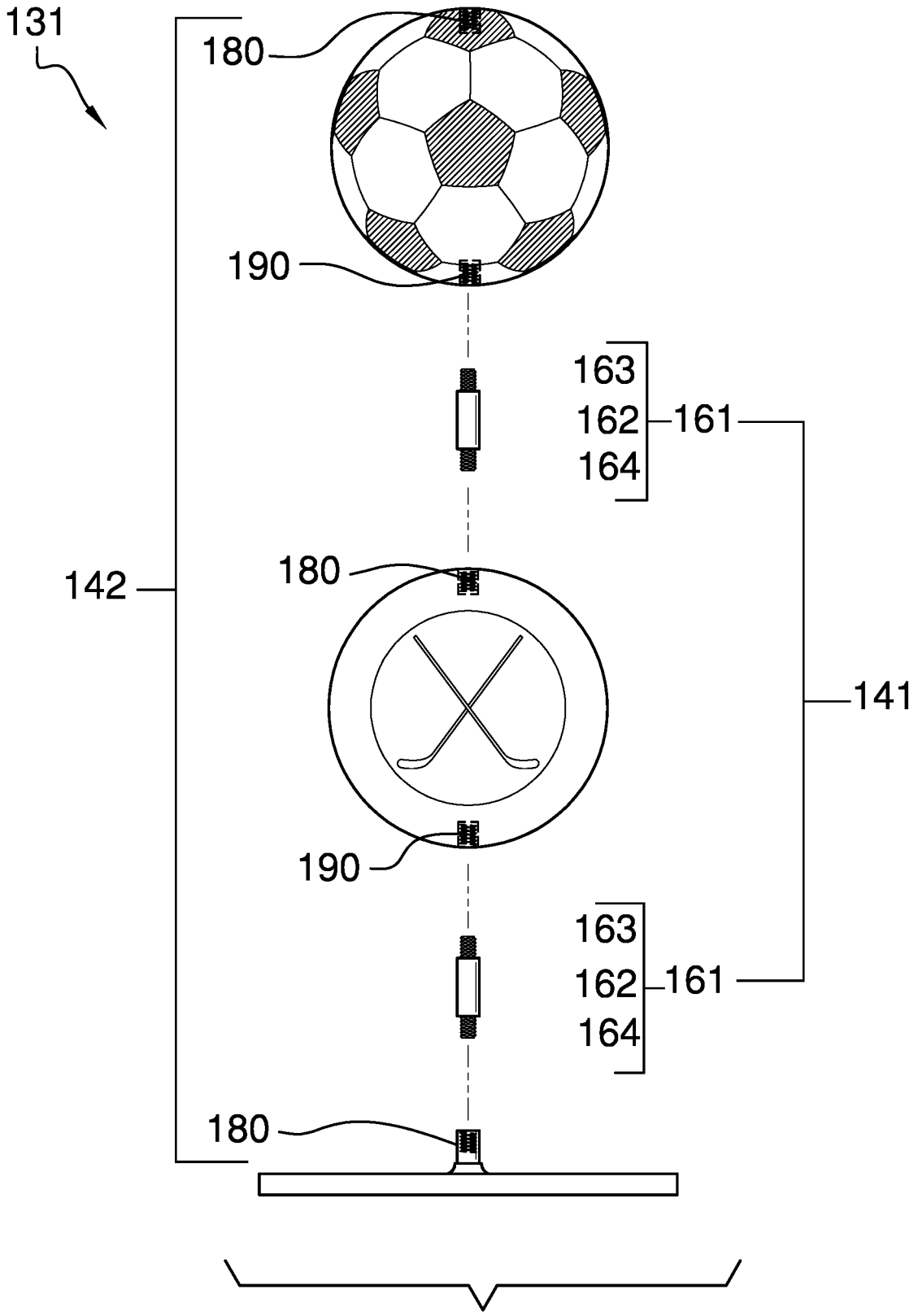
FIG. 3 is a detail view of an embodiment of the disclosure.
Figure 4:
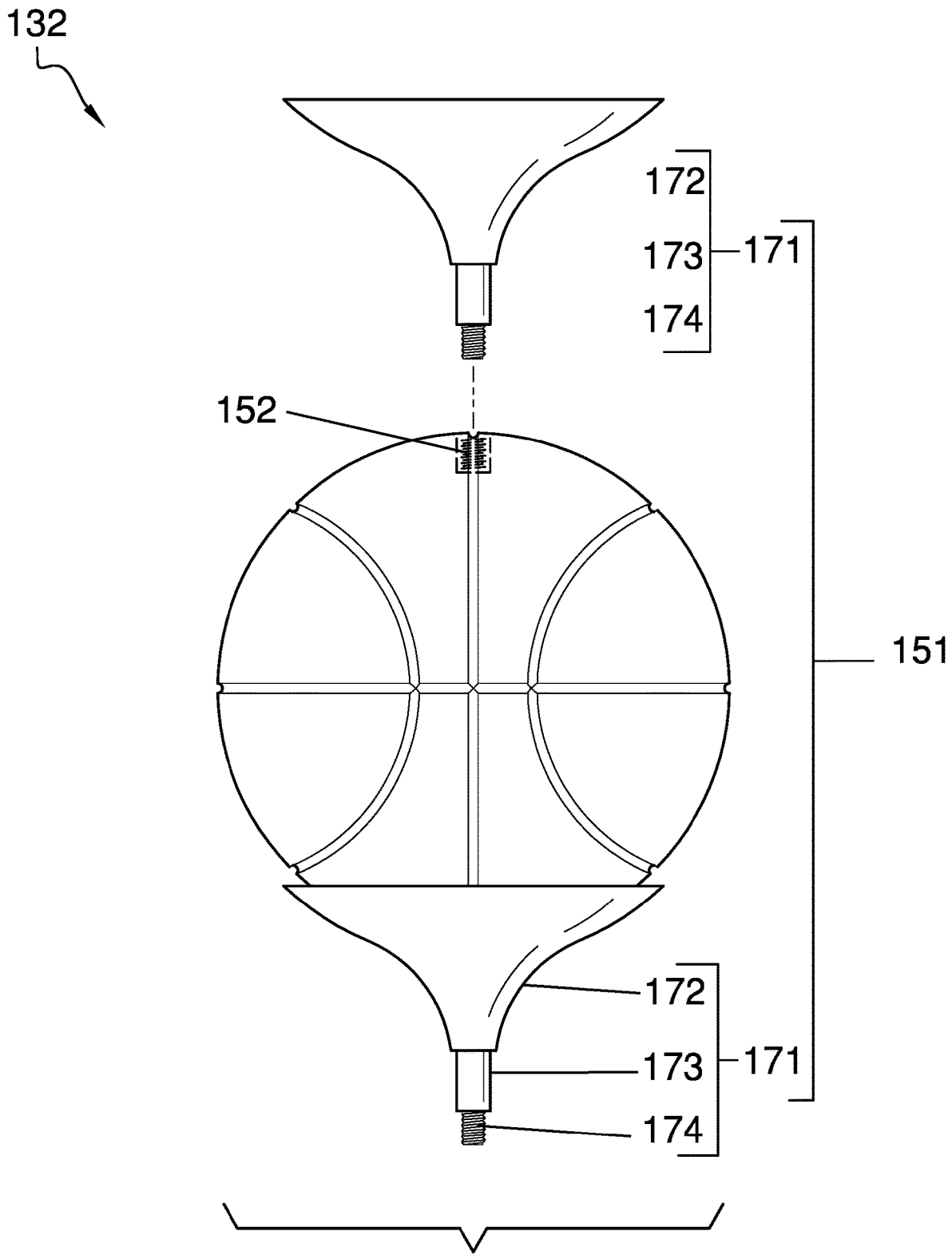
FIG. 4 is a detail view of an alternate embodiment of the disclosure.

Detailed reference will now be made to one or more potential embodiments of the disclosure, which are illustrated in FIGS. 1 through 4.

The sports memorabilia rack 100 (hereinafter invention) is a display rack. The invention 100 comprises a pedestal structure 101, a plurality of sport figurines 102 and a plurality of connecting structures 103. Each connecting structure selected from the plurality of connecting structures is a threaded connection. Each selected connecting structure forms an attachment selected from the group consisting of: a) attaching an initial sport figurine selected from the plurality of sport figurines 102 to a subsequent sport figurine selected from the plurality of sport figurines 102; and, b) attaching a sport figurine selected from the plurality of sport figurines 102 to the pedestal structure 101. The plurality of connecting structures 103 align the plurality of sport figurines 102 along a vertically oriented axis. The pedestal structure 101 is a load bearing structure. The pedestal structure 101 forms the final link of the load path that transfers the load of the invention 100 to a supporting surface.

The pedestal structure 101 is a load bearing structure. The pedestal structure 101 forms the inferior structure of the invention 100. The pedestal structure 101 forms the final link in the load path that transfers the load of the invention 100 to the supporting surface. The pedestal structure 101 is a disk shaped structure. The plurality of connecting structures 103 attaches the plurality of sport figurines 102 to the superior congruent end of the disk structure of the pedestal structure 101. The pedestal structure 101 is further formed with a pedestal structure 101 superior nut 180. The superior nut 180 is described elsewhere in this disclosure.

Each sport figurine selected from the plurality of sport figurines 102 is a figurine. Each selected sport figurine is a three dimensional structure that presents an indicia of a sport. The indicia presented by each selected sport figurine stimulates a sentiment of the indicated sport in a viewer. This disclosure assumes, but does not require, that the indicia presented by each selected sport figurine is of a ball or ball-like structure associated with the sport.

The plurality of sport figurines 102 comprises a baseball figurine 121, a football figurine 122, a golf figurine 123, a basketball figurine 124, a tennis figurine 125, a soccer figurine 126, a hockey figurine 127, and a keter figurine 128.

The baseball figurine 121 is the sport figurine selected from the plurality of sport figurines 102 that is associated with the sport of baseball. The baseball figurine 121 is formed with a superior nut 180 called the baseball figurine 121 superior nut 180. The baseball figurine 121 is formed with an inferior nut 190 called the baseball figurine 121 inferior nut 190.

The football figurine 122 is the sport figurine selected from the plurality of sport figurines 102 that is associated with the sport of football. The football figurine 122 is formed with a superior nut 180 called the football figurine 122 superior nut 180. The football figurine 122 is formed with an inferior nut 190 called the football figurine 122 inferior nut 190.

The golf figurine 123 is the sport figurine selected from the plurality of sport figurines 102 that is associated with the sport of golf. The golf figurine 123 is formed with a superior nut 180 called the golf figurine 123 superior nut 180. The golf figurine 123 is formed with an inferior nut 190 called the golf figurine 123 inferior nut 190.

The basketball figurine 124 is the sport figurine selected from the plurality of sport figurines 102 that is associated with the sport of basketball. The basketball figurine 124 is formed with a superior nut 180 called the basketball figurine 124 superior nut 180. The basketball figurine 124 is formed with an inferior nut 190 called the basketball figurine 124 inferior nut 190.

The tennis figurine 125 is the sport figurine selected from the plurality of sport figurines 102 that is associated with the sport of tennis. The tennis figurine 125 is formed with a superior nut 180 called the tennis figurine 125 superior nut 180. The tennis figurine 125 is formed with an inferior nut 190 called the tennis figurine 125 inferior nut 190.

The soccer figurine 126 is the sport figurine selected from the plurality of sport figurines 102 that is associated with the sport of soccer. The soccer figurine 126 is formed with a superior nut 180 called the soccer figurine 126 superior nut 180. The soccer figurine 126 is formed with an inferior nut 190 called the soccer figurine 126 inferior nut 190.

The hockey figurine 127 is the sport figurine selected from the plurality of sport figurines 102 that is associated with the sport of hockey. The hockey figurine 127 is formed with a superior nut 180 called the hockey figurine 127 superior nut 180. The hockey figurine 127 is formed with an inferior nut 190 called the hockey figurine 127 inferior nut 190.

The keter figurine 128 is the sport figurine selected from the plurality of sport figurines 102 that forms a keter. The keter is a headpiece. The keter is the sport figurine selected from the plurality of sport figurines 102 that forms the superior structure of the invention 100. The keter figurine 128 is formed with an inferior nut 190 called the keter figurine 128 inferior nut 190.

The superior nut 180 and the inferior nut 190 are described elsewhere in this disclosure.

The plurality of connecting structures 103 forms the structure that interconnects the plurality of sport figurines 102. The plurality of connecting structures 103 further forms the structure that attaches the plurality of sport figurines 102 to the pedestal structure 101. Each connecting structure selected from the plurality of connecting structures 103 is a fastening device. Each selected connecting structure forms a detachable attachment to a sport figurine selected from the plurality of sport figurines 102. A connecting structure selected from the plurality of connecting structures 103 forms a detachable attachment to the pedestal structure 101.

Each selected connecting structure interconnects the plurality of sport figurines 102 and the pedestal structure 101 by forming detachable attachments selected from the group consisting of: a) attaching an initial sport figurine selected from the plurality of sport figurines 102 to a subsequent sport figurine selected from the plurality of sport figurines 102; and, b) attaching a sport figurine selected from the plurality of sport figurines 102 to the pedestal structure 101.

In the first potential embodiment of the disclosure, the plurality of connecting structures 103 comprises a first-embodiment connecting structure 131. The first-embodiment connecting structure 131 forms a detachable attachment to each sport figurine selected from the plurality of sport figurines 102. The first-embodiment connecting structure 131 forms a detachable attachment to the pedestal structure 101. Each first-embodiment connecting structure 131 forms a plurality of detachable attachments selected from the group consisting of: a) attaching an initial sport figurine selected from the plurality of sport figurines 102 to a subsequent sport figurine selected from the plurality of sport figurines 102; and, b) attaching a sport figurine selected from the plurality of sport figurines 102 to the pedestal structure 101.

The first-embodiment connecting structure 131 further comprises a first-embodiment plurality of individual connecting structures 141 and a first-embodiment plurality of nut structures 142.

The first-embodiment plurality of individual connecting structures 141 comprises a collection of first-embodiment individual connecting structures 161. An initial first-embodiment individual connecting structure 161 selected from the first-embodiment plurality of individual connecting structures 141 forms the physical detachable connection between a sport figurine selected from the plurality of sport figurines 102 and the pedestal structure 101. The balance of the first-embodiment individual connecting structures 161 remaining in the first-embodiment plurality of individual connecting structures 141 form the physical detachable connections between the sport figurine selected from the plurality of sport figurines 102.

Each first-embodiment individual connecting structure 161 selected from the first-embodiment plurality of individual connecting structures 141 further comprises a connecting post 162, a superior exterior screw thread 163, and an inferior exterior screw thread 164.

Each selected first-embodiment individual connecting structure 161 forms two threaded connection that: a) interconnect the plurality of sport figurines 102; and, b) attach the interconnected the plurality of sport figurines 102 to the pedestal structure 101. Each connecting post 162 is a rigid structure. The connecting post 162 is a prism shaped structure. The connecting post 162 forms the primary structure of the bolt formed by the selected first-embodiment individual connecting structure 161.

The superior exterior screw thread 163 is an initial exterior screw thread that is formed at a congruent end of the prism structure of the connecting post 162. The superior exterior screw thread 163 screws into the inferior nut 190 of any sport figurine selected from the plurality of sport figurines 102.

The inferior exterior screw thread 164 is a subsequent exterior screw thread that is formed in the prism structure of the connecting post 162. The inferior exterior screw thread 164 is formed at the congruent end of the connecting post 162 that is distal from the superior exterior screw thread 163. The inferior exterior screw thread 164 screws into a structure selected from the group consisting of: a) the pedestal structure 101 superior nut 180; and, b) the superior nut 180 of any sport figurine selected from the plurality of sport figurines 102.

The first-embodiment plurality of nut structures 142 forms a collection of nuts that are formed in the pedestal structure 101 and in each sport figurine selected from the plurality of sport figurines 102. The first-embodiment plurality of nut structures 142 are divided into a plurality of superior nuts 180 and a plurality of inferior nuts 190. The inferior exterior screw thread 164 of a first-embodiment individual connecting structure 161 selected from the first-embodiment plurality of individual connecting structures 141 screws into the pedestal structure 101 superior nut 180. The inferior exterior screw thread 164 of the remaining first-embodiment individual connecting structures 161 screw into the superior nut 180 of a sport figurine selected from the plurality of sport figurines 102.

In a second embodiment of the disclosure, the plurality of connecting structures 103 comprises a second-embodiment connecting structure 132. The second-embodiment connecting structure 132 forms a detachable attachment to each sport figurine selected from the plurality of sport figurines 102. The second-embodiment connecting structure 132 forms a detachable attachment to the pedestal structure 101. Each second-embodiment connecting structure 132 forms a plurality of detachable attachments selected from the group consisting of: a) attaching an initial sport figurine selected from the plurality of sport figurines 102 to a subsequent sport figurine selected from the plurality of sport figurines 102; and, b) attaching a sport figurine selected from the plurality of sport figurines 102 to the pedestal structure 101.

The second-embodiment connecting structure 132 further comprises a second-embodiment plurality of individual connecting structures 151 and a second-embodiment plurality of nut structures 152.

The second-embodiment plurality of individual connecting structures 151 comprises a collection of second-embodiment individual connecting structures 171. An initial second-embodiment individual connecting structure 171 selected from the second-embodiment plurality of individual connecting structures 151 forms the physical detachable connection between a sport figurine selected from the plurality of sport figurines 102 and the pedestal structure 101. The balance of the second-embodiment individual connecting structures 171 remaining in the second-embodiment plurality of individual connecting structures 151 form the physical detachable connections between the plurality of sport figurines 102.

Each selected second-embodiment individual connecting structure 171 is identical. Each selected second-embodiment individual connecting structure 171 forms a container that receives a sport figurine selected from the plurality of sport figurines 102. Each selected second-embodiment individual connecting structure 171 forms a threaded connection that screws into a structure selected from the group consisting of: a) the pedestal structure 101 superior nut 180; and, b) the superior nut 180 of any sport figurine selected from the plurality of sport figurines 102.

Each second-embodiment individual connecting structure 171 selected from the second-embodiment plurality of individual connecting structures 151 comprises a figurine mount 172, a support post 173, and a figurine mount exterior screw thread 174.

The figurine mount 172 is a rigid structure. The figurine mount 172 forms the containment structure that receives any sport figurine selected from the plurality of sport figurines 102. The figurine mount 172 holds the received selected sport figurine in a fixed position as the selected sport figurine is displayed by the invention 100.

The support post 173 is a prism shaped structure. The support post 173 attaches to the figurine mount 172 such that the support post 173 forms the inferior structure of the selected second-embodiment individual connecting structure 171. The support post 173 forms a bolt that secures the selected second-embodiment individual connecting structure 171 to a nut selected from the second-embodiment plurality of nut structures 152.

The figurine mount exterior screw thread 174 forms the exterior screw thread of the bolt structure of the support post 173. The figurine mount exterior screw thread 174 is formed at the congruent end of the prism structure of the support post 173 that is distal from the figurine mount 172. The figurine mount exterior screw thread 174 screws into a nut selected from the second-embodiment plurality of nut structures 152.

The second-embodiment plurality of nut structures 152 forms a collection of nuts that are formed in the pedestal structure 101 and in each sport figurine selected from the plurality of sport figurines 102. The second-embodiment plurality of nut 8 structures 152 are superior nuts 180. The figurine mount exterior screw thread 174 of a second-embodiment individual connecting structure 171 selected from the second-embodiment plurality of individual connecting structures 151 screws into the pedestal structure 101 superior nut 180. The figurine mount exterior screw thread 174 of the remaining second-embodiment individual connecting structures 171 screw into the superior nut 180 of a sport figurine selected from the plurality of sport figurines 102.

Each individual second nut structure selected from the second-embodiment plurality of nut structures 152 is identical to the corresponding first nut structure selected from the first-embodiment plurality of nut structures 142 that is described in the first potential embodiment of this disclosure.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Ball: As used in this disclosure, a ball refers to an object with a spherical or nearly spherical shape.

Bolt: As used in this disclosure, a bolt is a cylindrical shaft that is formed with an exterior screw thread. A bolt is defined with an outer dimension.

Cant: As used in this disclosure, a cant is an angular deviation from one or more reference lines (or planes) such as a vertical line (or plane) or a horizontal line (or plane).

Cavity: As used in this disclosure, a cavity is a negative space that is formed within an object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Exterior Screw Thread: An exterior screw thread is a ridge wrapped around the outer surface of a tube in the form of a helical structure that is used to convert rotational movement into linear movement.

Figurine: As used in this disclosure, a figurine is a three dimensional structure resembling (or representing) a human, animal, natural, or symbolic sentiment.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Image: As used in this disclosure, an image is an optical representation or reproduction of an indicia or of the appearance of something or someone. See indicia sentiment optical character recognition. See Label and Pattern.

Indicia: As used in this disclosure, the term indicia refers to a set of markings that identify a sentiment. See sentiment.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Interior Screw Thread: An interior screw thread is a groove that is formed around the inner surface of a tube in the form of a helical structure that is used to convert rotational movement into linear movement.

Keter: As used in this disclosure, a keter is an end piece that attaches to one of the congruent ends of a prism-like structure.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Mount: As used in this disclosure, a mount is a mechanical structure that attaches or incorporates an object into a load path.

N-gon: As used in this disclosure, an N-gon is a regular polygon with N sides wherein N is a positive integer number greater than 2.

Negative Space: As used in this disclosure, negative space is a method of defining an object through the use of open or empty space as the definition of the object itself, or, through the use of open or empty space to describe the boundaries of an object.

Nut: As used in this disclosure, a nut is a first object that is formed with a cylindrical negative space that further comprises an interior screw thread such that a second object with a matching exterior screw thread can screwed into the first object forming a threaded connection. A nut is further defined with an inner dimension.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pyramid: As used in this disclosure, a pyramid is a three-dimensional shape that comprises a base formed in the shape of an N-gon (wherein N is an integer) with N triangular faces that rise from the base to converge at a point above the base. The center axis of a pyramid is the line drawn from the vertex where the N faces meet to the center of the N-gon base. The center axis of a right pyramid is perpendicular to the N-gon base. Pyramids can be further formed with circular or elliptical bases which are commonly referred to as a cone or an elliptical pyramid respectively. A pyramid is defined with a base, an apex, and a lateral face. The base is the N-gon shaped base described above. The apex is the vertex that defines the center axis. The lateral face is formed from the N triangular faces described above.

Sentiment: As used in this disclosure, a sentiment refers to a symbolic meaning or message that is communicated through the use of an object or an image, potentially including a text based image. See image and optical character recognition.

Sphere: As used in this disclosure, a sphere refers to a structure wherein every point of the surface of the structure is equidistant from a center point. A circle refers to the two dimensional structure that that is projected onto the bifurcating plane of a spherical section by the surface of the sphere. All the points of the circle are equidistant from a center point that is found by the perpendicular projection of the center of the sphere through the bifurcating plane.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation. A note on usage: when fastening two objects the exterior screw thread of the threaded connection can be formed on a first object and the matching interior screw thread of the threaded connection can be formed in a second object without significant regard as to which object of the two objects is the first object and which of the two objects is the second object. When the assignment of the type of screw thread does not provide a significant technical advantage, the screw thread assigned to the first object will simply be referred to as the "exterior/interior screw thread" with the understanding that when the two objects are fastened together one of the two objects will have an exterior screw thread and the remaining object will have an interior screw thread.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A sports memorabilia rack comprising wherein the sports memorabilia rack comprises a pedestal structure, a plurality of sport figurines and a plurality of connecting structures;

wherein each connecting structure selected from the plurality of connecting structures is a threaded connection;

wherein each selected connecting structure forms an attachment selected from the group consisting of: a) attaching an initial sport figurine selected from the plurality of sport figurines to a subsequent sport figurine selected from the plurality of sport figurines; and, b) attaching a sport figurine selected from the plurality of sport figurines to the pedestal structure;

wherein the plurality of connecting structures align the plurality of sport figurines along a vertically oriented axis;

wherein each sport figurine selected from the plurality of sport figurines is a figurine;

wherein each selected sport figurine is a three dimensional structure that presents an indicia of a sport;

wherein the indicia presented by each selected sport figurine stimulates a sentiment;

wherein the plurality of connecting structures forms the structure that interconnects the plurality of sport figurines;

wherein the plurality of connecting structures further forms the structure that attaches the plurality of sport figurines to the pedestal structure.

2. The sports memorabilia rack according to claim 1 wherein the pedestal structure is a load bearing structure;

wherein the pedestal structure forms the final link of the load path that transfers the load of the sports memorabilia rack to a supporting surface;

wherein the pedestal structure forms the inferior structure of the sports memorabilia rack;

wherein the pedestal structure forms the final link in the load path that transfers the load of the sports memorabilia rack to the supporting surface;

wherein the pedestal structure is a disk shaped structure;

wherein the plurality of connecting structures attaches the plurality of sport figurines to the superior congruent end of the disk structure of the pedestal structure;

wherein the pedestal structure is further formed with a pedestal structure superior nut.

3. The sports memorabilia rack according to claim 2 wherein each selected connecting structure forms a detachable attachment to a sport figurine selected from the plurality of sport figurines;

wherein a connecting structure selected from the plurality of connecting structures forms a detachable attachment to the pedestal structure;

wherein each selected connecting structure interconnects the plurality of sport figurines and the pedestal structure by forming detachable attachments selected from the group consisting of: a) attaching an initial sport figurine selected from the plurality of sport figurines to a subsequent sport figurine selected from the plurality of sport figurines; and, b) attaching a sport figurine selected from the plurality of sport figurines to the pedestal structure.

4. The sports memorabilia rack according to claim 3 wherein the plurality of connecting structures comprises a first-embodiment connecting structure;

wherein the first-embodiment connecting structure forms a detachable attachment to each sport figurine selected from the plurality of sport figurines;

wherein the first-embodiment connecting structure forms a detachable attachment to the pedestal structure;

wherein each first-embodiment connecting structure forms a plurality of detachable attachments selected from the group consisting of: a) attaching an initial sport figurine selected from the plurality of sport figurines to a subsequent sport figurine selected from the plurality of sport figurines; and, b) attaching a sport figurine selected from the plurality of sport figurines to the pedestal structure.

5. The sports memorabilia rack according to claim 4 wherein the first-embodiment connecting structure further comprises a first-embodiment plurality of individual connecting structures and a first-embodiment plurality of nut structures;

wherein the first-embodiment plurality of individual connecting structures comprises a collection of first-embodiment individual connecting structures;

wherein an initial first-embodiment individual connecting structure selected from the first-embodiment plurality of individual connecting structures forms the physical detachable connection between a sport figurine selected from the plurality of sport figurines and the pedestal structure;

wherein the balance of the first-embodiment individual connecting structures remaining in the first-embodiment plurality of individual connecting structures form the physical detachable connections between the sport figurine selected from the plurality of sport figurines;

wherein the first-embodiment plurality of nut structures forms a collection of nuts that are formed in the pedestal structure and in each sport figurine selected from the plurality of sport figurines;

wherein the first-embodiment plurality of nut structures are divided into a plurality of superior nuts and a plurality of inferior nuts;

wherein the inferior exterior screw thread of a first-embodiment individual connecting structure selected from the first-embodiment plurality of individual connecting structures screws into the pedestal structure superior nut;

wherein the inferior exterior screw thread of the remaining first-embodiment individual connecting structures screw into the superior nut of a sport figurine selected from the plurality of sport figurines.

6. The sports memorabilia rack according to claim 5 wherein each first-embodiment individual connecting structure selected from the first-embodiment plurality of individual connecting structures further comprises a connecting post, a superior exterior screw thread, and an inferior exterior screw thread;

wherein each connecting post is a rigid structure;

wherein the connecting post forms the primary structure of the bolt formed by the selected first-embodiment individual connecting structure;

wherein the superior exterior screw thread is an initial exterior screw thread that is formed at a congruent end of the connecting post;

wherein the superior exterior screw thread screws into the inferior nut of any sport figurine selected from the plurality of sport figurines;

wherein the inferior exterior screw thread is a subsequent exterior screw thread that is formed in the connecting post;

wherein the inferior exterior screw thread is formed at the congruent end of the connecting post that is distal from the superior exterior screw thread;

wherein the inferior exterior screw thread screws into a structure selected from the group consisting of: a) the pedestal structure superior nut; and, b) the superior nut of any sport figurine selected from the plurality of sport figurines.

* * * * *